US005987759A

United States Patent [19]

Nita

[11] Patent Number: 5,987,759

[45] Date of Patent: Nov. 23, 1999

[54] PENCIL SHARPENER

[76] Inventor: Ilie Nita, 425 Carl Miller Dr., Antioch, Tenn. 37013

[21] Appl. No.: 08/910,993

[22] Filed: Aug. 14, 1997

[51] Int. Cl.[6] ..... B43L 23/08

[52] U.S. Cl. ..... 30/454; 30/458

[58] Field of Search ..... 30/451, 453–455, 30/458, 459; 7/160

[56] References Cited

U.S. PATENT DOCUMENTS

| | | |
|---|---|---|
| 329,486 | 11/1885 | Price . |
| D. 341,251 | 11/1993 | Bensman et al. . |
| 661,955 | 11/1900 | Cranstone . |
| 703,967 | 7/1902 | O'Byrne . |
| 879,998 | 2/1908 | Augir . |
| 1,780,371 | 11/1930 | Benczalski . |
| 4,485,862 | 12/1984 | Mattheis et al. . |
| 5,367,777 | 11/1994 | Nguyen et al. . |

FOREIGN PATENT DOCUMENTS

| | | | |
|---|---|---|---|
| 168171 | 6/1934 | Switzerland . | |
| 708331 | 5/1954 | United Kingdom | 30/455 |

*Primary Examiner*—Douglas D. Watts
*Attorney, Agent, or Firm*—Richard C. Litman

[57] ABSTRACT

A pencil sharpener with structure for covering the pencil receiving inlet of the sharpener, to prevent the back flow of the pencil shavings and accidental contact between the user and the cutting blades of the sharpener when the device is not in use. The device may have a key chain to enhance its portability, and include additional sharpeners to sharpen pencils (or crayons) of different sizes.

12 Claims, 4 Drawing Sheets

PENCIL SHARPENER

BACKGROUND OF THE INVENTION

1. Field of the Invention

The present invention relates to pencil sharpeners, and more particularly, to a pencil sharpener with a closable pencil receiving inlet to prevent the pencil shavings from backwashing out through the same inlet.

2. Description of Related Art

Prior pencil sharpeners include various devices that sharpen wood pencils and also house the pencil shavings and chipped lead or graphite for later disposal. Prior pencil sharpeners also include housings for the sharpened points of pencils. However, prior pencil sharpeners all include pencil receiving inlets that are open, permitting the escape of pencil shavings back out of the open pencil receiving inlets or openings.

Accordingly, there is a need for a pencil sharpener that can selectively enclose the pencil receiving inlet when the pencil sharpener is not in use, to prevent the back flow of pencil shavings out through the same opening, and prevent the user from contacting the sharp cutting blades of the pencil sharpener. In addition, there is a need for a pencil sharpener that is highly portable, and capable of sharpening different sized pencils. Further, there is a need for a device as described above that is easily and economically produced.

U.S. Pat. No. 329,486 issued to Price on Nov. 3, 1885 describes a pencil sharpener which includes a dust chamber that reduces the noise generated by the sharpening process, by enclosing the outside of the cutter-holder and pencil guide. The device also includes a pencil receiving inlet that is not enclosed after the pencil sharpener is used, permitting the back flow of pencil shavings and potential contact between the user and the cutting blades.

U.S. Pat. No. 661,955 issued to Cranstone on Nov. 20, 1900 describes a combination pencil point protector and sharpener. The device includes a pencil receiving inlet that is not enclosed after the pencil sharpener is used, permitting the back flow of pencil shavings and potential contact between the user and the cutting blades.

U.S. Pat. No. 703,967 issued to O'Byrne on Aug. 21, 1902 describes a wood pencil sharpener which is constructed to cut the wood of the pencil with the grain, to avoid the breaking or splitting of the wood. The device includes a pencil receiving inlet that is not enclosed after the pencil sharpener is used, permitting the back flow of pencil shavings and potential contact between the user and the cutting blades.

U.S. Pat. No. 879,998 issued to Augir on Feb. 25, 1908 describes a novelty device adapted for use as a pencil sharpener having an interior chamber adapted to receive pencil shavings and dust produced by sharpening a pencil. The device includes a pencil receiving inlet that is not enclosed after the pencil sharpener is used, permitting the back flow of pencil shavings and potential contact between the user and the cutting blades.

U.S. Pat. No. 1,780,371 issued to Benczalski on Nov. 4, 1930 describes another pencil sharpener. This sharpener device is covered by removable casing. The device also includes a pencil receiving inlet that is not enclosed after the pencil sharpener is used, permitting the back flow of pencil shavings and potential contact between the user and the cutting blades.

U.S. Pat. No. 4,485,862 issued to Mattheis et al. on Dec. 4, 1984 describes a pencil sharpener adapted to sharpen a plurality of different sizes and to a method for making such a device. The device includes a pencil receiving inlet that is not enclosed after the pencil sharpener is used, permitting the back flow of pencil shavings and potential contact between the user and the cutting blades.

U.S. Pat. No. 5,367,777 issued to Nguyen et al. on Nov. 29, 1994 describes a wood pencil sharpener and pocket holder which allows a pencil to be stored in a shirt pocket such that the pencil and pencil point are contained within a tube and covered sharpener. The pencil is held in a tubular member. The device also includes a pencil receiving inlet that is not enclosed after the pencil is removed, permitting the back flow of pencil shavings and potential contact between the user and the cutting blades.

U.S. Pat. No. Design 342,251 issued to Bensman et al. illustrates a talking key chain. The device illustrates the attachment of a key chain to the rest of the device.

Swiss Patent Application of Wenger published on Mar. 31, 1934 describes a novelty pencil shaving device which also includes a pencil receiving inlet that is not enclosed after the pencil sharpener is used, permitting the back flow of pencil shavings and potential contact between the user and the cutting blades.

None of the above noted inventions and patents, taken either singly or in combination, is seen to describe the instant invention as claimed.

SUMMARY OF THE INVENTION

By the present invention, a device that includes a pencil sharpener with desired features of safety, cleanliness, and portability is disclosed. The present device includes structure for closing the pencil receiving inlet of the pencil sharpener to prevent the back flow of the pencil shavings and contact between the user and the cutting blades of the sharpener. The device may be used in conjunction with a key chain to enhance its portability. The device may further include additional sharpeners for differently size pencils. The device may, in addition to sharpening pencils, be used to hone a variety of tubular shapes requiring sharpened points, such as crayons and the like.

Accordingly, it is a principal object of the present invention to provide a portable pencil sharpener which effectively covers the pencil receiving inlet of the pencil sharpener when the device is not in use, to prevent the back flow of pencil shavings.

Another of the objects of the present invention is to provide a portable pencil sharpener which effectively prevents accidental contact between the user and the cutting blades of the pencil sharpeners when the device is not in use.

Yet another of the objects of the present invention is to provide a portable pencil sharpener having different size sharpeners for cutting differently sized (in diameter) pencils.

Still another of the objects of the present invention is to provide a portable pencil sharpener which can be provided with a key chain to enhance its portability.

An object of the present invention is to provide a portable pencil sharpener which is economical to produce.

It is an object of the invention to provide improved elements and arrangements thereof in an apparatus for the purposes described which is inexpensive, dependable and fully effective in accomplishing its intended purposes.

These and other objects of the present invention will be more readily apparent as the nature of the invention is hereinafter more fully described, illustrated and claimed with reference being made to the attached drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a portable pencil sharpener with structure for selectively opening and closing the inlet through which a pencil is inserted, to be met by a blade, to prevent a backwash of pencil shavings out through the pencil receiving inlet. The device is highly portable and it can be carried on a key chain.

Embodiments of the various aspects of the present invention will now be explained with reference to the accompanying drawings. By way of illustration and not limitation, FIGS. 1–7 are presented to show the preferred embodiments of the present invention.

All the embodiments presented include the novel feature of selectively closing and opening the pencil receiving inlet 17 to prevent the back flow of pencil shavings out through the same pencil receiving inlet 17 and accidental contact between the user and the cutting means 20 housed in the sharpener, when the device is not in use.

Figure 3:
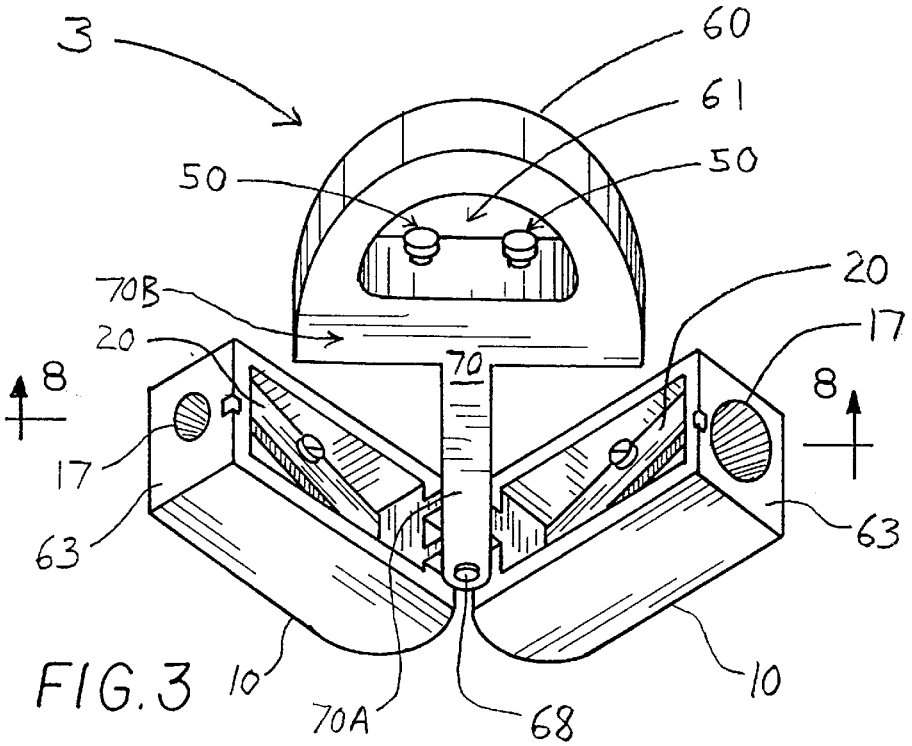
FIG. 3 is a perspective view of another embodiment of the pencil sharpener.

In one embodiment of the present invention, seen in FIG. 3, the pencil sharpener 3 includes a frame 70 in the shape of a "T". A pair of point cutting assemblies 10 are hinged onto the lower portion of the vertical section of the "T"-shaped frame 70. A hinge 68 with a pin-in-hole design that uses one pin to hinge both of the point cutting assemblies 10 to the frame 70 is utilized. Each of the point cutting assemblies 10 includes a cutting blade assembly 20 which is known to those skilled in the art, and a pencil receiving inlet 17 adapted to axially position a pencil that is received into a pencil receiving inlet 17 for cutting by the cutting blade assembly 20. It is generally preferred that each of the point cutting assemblies 10 is specialized to cut a particular size of pencil, thus permitting the sharpening of pencils with different diameters.

Hinge 68 rotatably attaches both of the point cutting assemblies 10 to the "T"-shaped frame 70 so that when the point cutting assemblies 10 are retracted into the "T"-shaped frame 70, the pencil receiving inlets 17 are covered by the horizontal bar 70*b* of the frame 70, and likewise for the cutting blade assemblies 20, by the vertical bar 70*a* of the frame 70. When the point cutting assemblies are fully retracted into the frame 70, the pencil shavings cannot flow back out of the pencil receiving inlets 17, and the user cannot accidentally contact the cutting blade assemblies 20.

Figure 8:
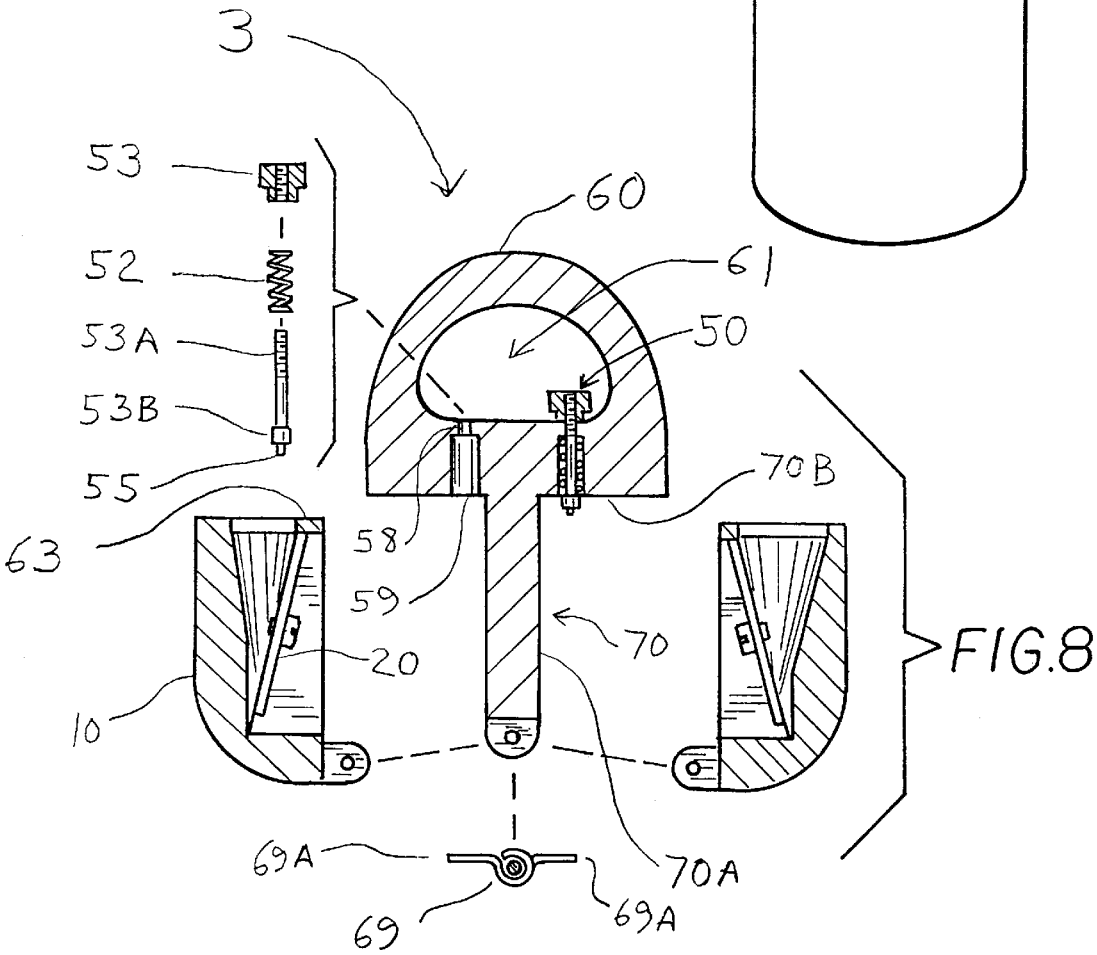
FIG. 8 is an exploded, sectional view taken generally along lines 8—8 of FIG. 3.

The locking mechanism in FIG. 3 is more clearly illustrated in FIG. 8. A passageway made up of a small upper bore 58 followed by a wider lower bore 59, is formed in the horizontal bar 70*b* of the frame 70. The locking structure 50 is substantially housed in the bores 58,59. A middle member 53*a* with a diameter slightly smaller than that of the upper bore 58 extends through the upper bore 58 and the lower bore 59. A lower member 53*b* has a diameter slightly smaller than the large lower bore 59. A locking nib 55 extends downwardly from the lower member 53*b*. A compression spring 52 fits in the large lower bore 59 and rests on the lower member 53*b*, surrounding the lower portion of the middle member 53*a*. An upper member 53 having a diameter larger than the small upper bore 58 is attached, e.g., threaded, onto the end of the middle member 53*a* that extends through the small upper bore 58. Pulling on the upper member 53 compresses the spring 52 and the locking nib 55 is retracted into the large lower bore 59, permitting the point cutting assembly 10 to retract fully into the frame 70. When the upper member 53 is released, the nib 55 contacts the cutting face 63 of the point cutting assembly 10. The pulling of the upper member 53 while the point cutting assembly 10 is retracted into the frame 70 removes the contact between the locking end section 55 and the cutting face 63, thereby permitting the point cutting assembly 10 to swing laterally and receive a pencil for sharpening.

With further reference to FIG. 8, the hinge 68, positioned at the lower portion of the vertical bar 70*a* of the frame 70, includes a spiral spring 69 housed in the lower portion of the vertical bar of the "T"-shaped frame. Each of the extended end sections 69A of the spring 69 makes contact with each of the point cutting assemblies 10 to twist and store spring energy when the point cutting assemblies are locked into the "T"-shaped frame 70 by the locking mechanism 50. The spiral spring 69 untwists and releases the stored spring energy when a locking mechanism 50 is released by pulling on an upper member 53 of the locking mechanism 50, so that the point cutting assembly 10 is readily and rotatably unhinged from the "T"-shaped frame 70.

Figure 4:
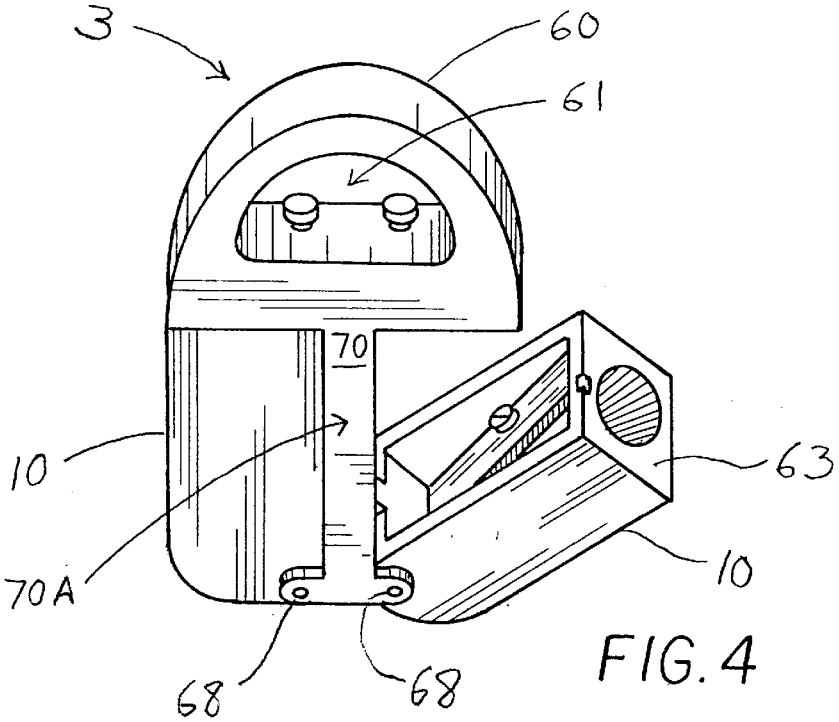
FIG. 4 is a perspective view of yet another embodiment of the pencil sharpener.

In the embodiment of the invention shown in FIG. 4, the pencil sharpener device 5 includes a pair of the point cutting assemblies 10 rotatably attached to the "T"-shaped frame 70 by two independently operable hinges 68 located at the lower portion of the vertical bar 70*a* of the "T"-shaped frame 70. There are two separate pin hinges 68, one for each of the two point cutting assemblies 10, for hinging the point cutting assemblies 10 to the frame 70.

Figure 5:
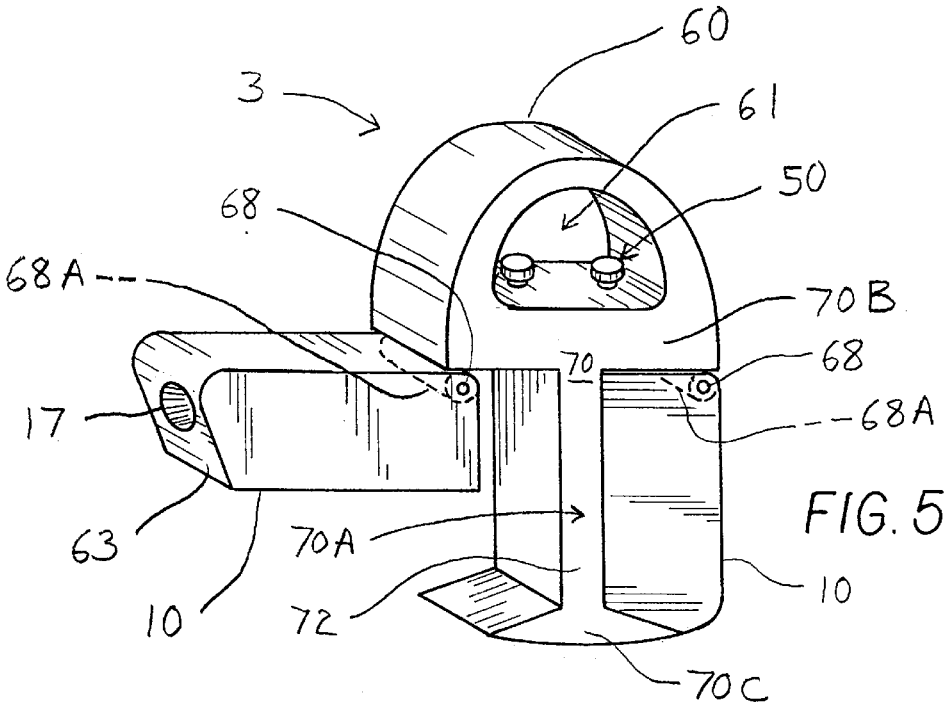
FIG. 5 is a perspective view of still another embodiment of the pencil sharpener.

Another embodiment of the present invention wherein a pair of point cutting assemblies 10 are utilized, is seen in FIG. 5. A base portion 70C extends horizontally from the lower end portion 72 of the vertical bar 70A of the "T"-shaped frame 70. A hinge receiving portion 68A extends downwardly from end sections of the horizontal bar 70B of the "T"-shaped frame 70. A point cutting assembly 10 is hinged to each of the hinge receiving portions 68A of the frame 70, such that when the point cutting assemblies 10 are unlocked from the frame 70, the point cutting assemblies 10 swing out laterally from the locked-in positions, exposing the pencil receiving inlets 17 for an easy ingress of the pencils. The base portion 70C effectively shields the pencil receiving inlets 17 of the point cutting assemblies 10 when the locking mechanism 50 frictionally engages the point cutting assemblies 10. The cutting blade assemblies (not shown in FIG. 5) are effectively shielded by the vertical bar 70*a* of the frame 70 when the point cutting assemblies 10 are locked by the locking mechanism 50.

In the embodiments illustrated in FIGS. 3, 4, 5, and 8, a handle portion 60 extends from each of the ends of the upper horizontal bar 70*b* of the "T"-shaped frame 70 to the other end, forming a substantially semicircular upper handle portion 60 and a cavity 61 above the upper horizontal bar 70*b* of the "T"-shaped frame 70. A key chain with an end ring (not shown in FIGS. 3–8) to enhance the portability of the present device may be provided. It is preferred that the end ring of a key chain extend around the handle portion 60 and in through the cavity 61 above the upper horizontal bar 70B of the "T"-shaped frame 70 to attach the key chain onto the invention.

Figure 6:
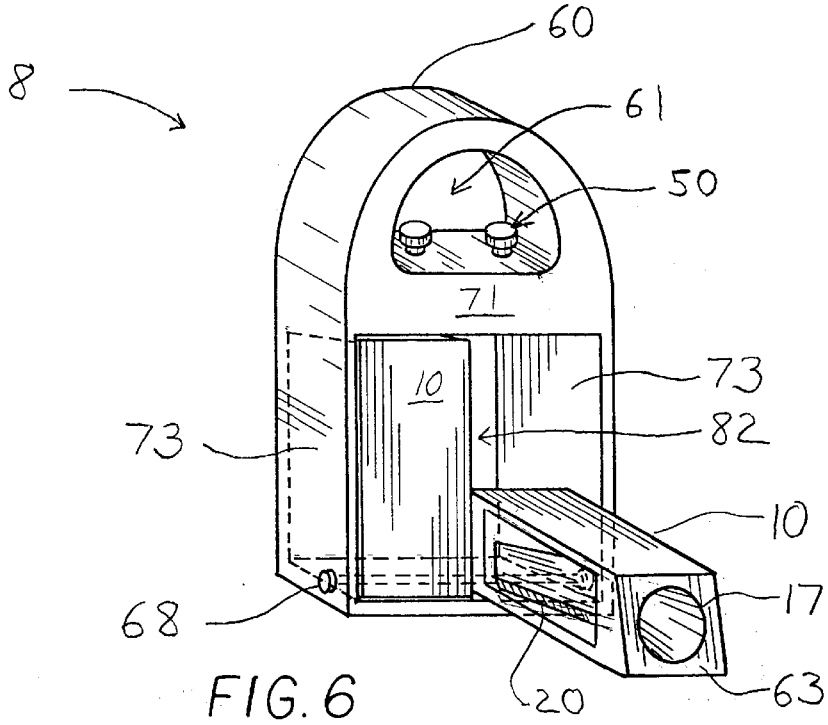
FIG. 6 is a perspective view of another embodiment of the pencil sharpener.

FIG. 6 shows another embodiment of the present invention, one without the "T"-shaped frame 70 of FIGS. 3–8. The pencil sharpener 8 includes a substantially box-shaped frame 71 with an open wall 82. A pair of point cutting assemblies 10 are hinged at the vertical sidewalls 73 of the box shaped frame 71 so that the point cutting assemblies 10 can enter and exit the box-shaped frame 71 via the open wall 82. In its closed position, the pencil receiving inlet 17 and the cutting blade assembly 20 of each of the point cutting assemblies 10 are enclosed within the frame 71 so that the user cannot accidentally make contact with the cutting blade assembly 20.

Figures 1, 2:
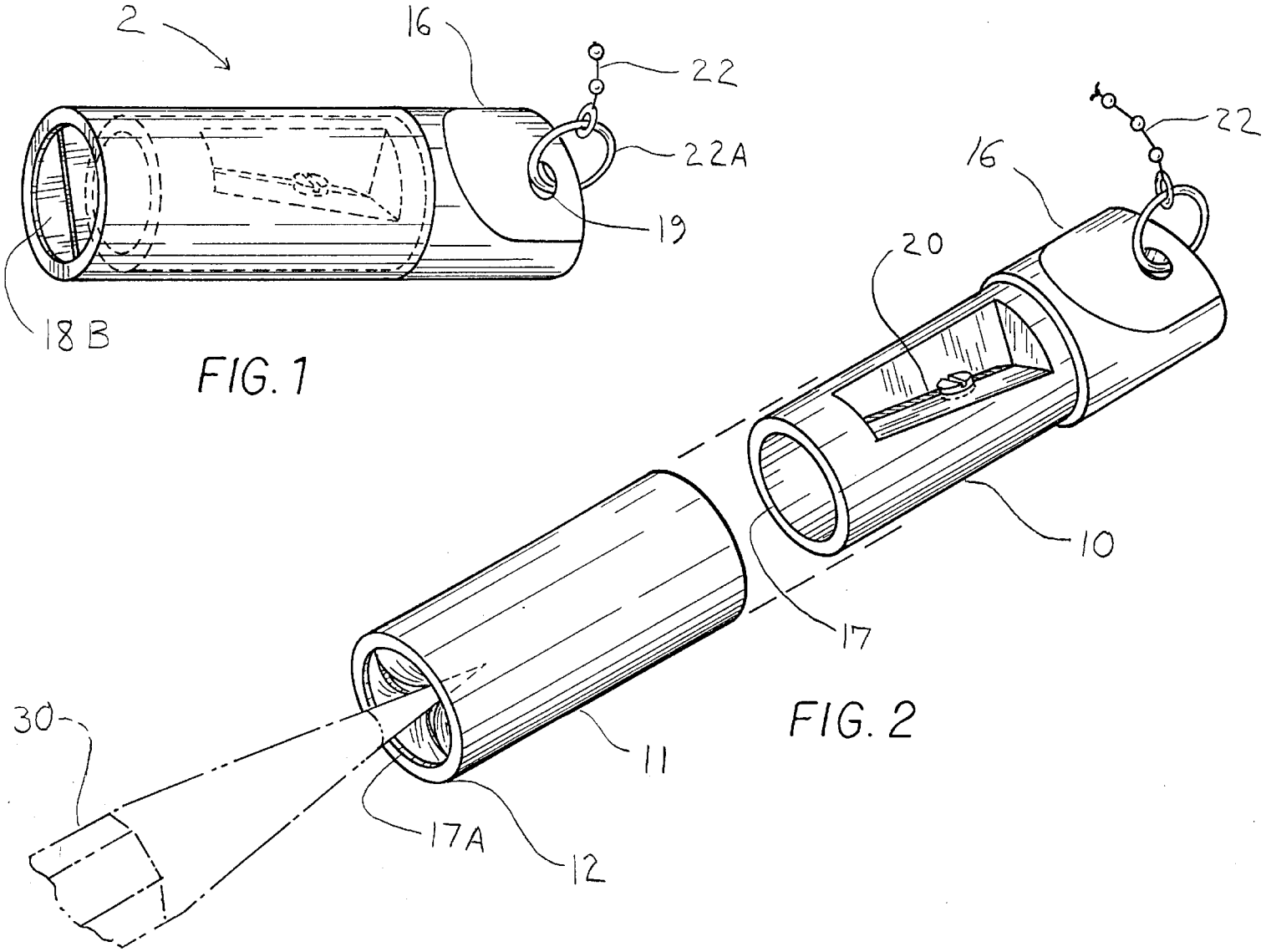
FIG. 1 is a perspective view of one embodiment of the pencil sharpener with the pencil receiving inlet in a closed position.
FIG. 2 is a perspective view of the invention as shown in FIG. 1, with the lid removed and a pencil point inserted into the pencil receiving inlet.
Figure 7:
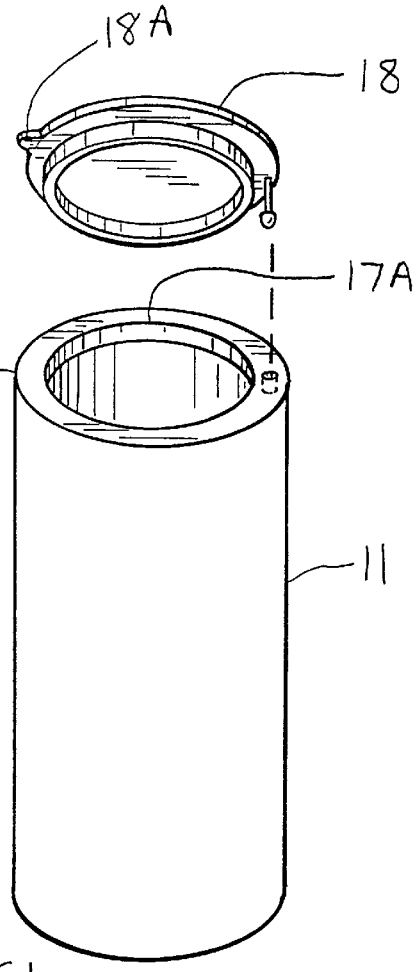
FIG. 7 is a perspective view of another embodiment of a removable lid, initially seen in FIG. 1.

In FIGS. 1, 2, and 7, other embodiments of the invention are illustrated. The pencil sharpener 2 includes a point cutting housing 10 having a pencil receiving inlet 17. The pencil receiving inlet 17 includes a cutting blade assembly 20. The point cutting assembly 10 is adapted to axially position a pencil 30 that is received into the pencil receiving inlet 17 for cutting by the cutting blade assembly 20. A removable lid 11 having a pencil receiving inlet 17A, is telescoped over the point cutting assembly 10 to house the pencil shavings generated during the pencil sharpening process, and store the shavings for later disposal. A hatch door 18 is attached at the lower base 12 (as in FIG. 7) of the removable lid 11 to enclose the pencil receiving inlets 17, 17A, and prevent the back flow of pencil shavings and accidental contact between the user and the cutting blade assembly 20 when the pencil is not placed into the pencil receiving inlet 17. The hatch door 18 can easily be opened by a pulling on the fingernail tab 18A so that the pencil can be inserted into the pencil receiving inlets 17, 17A.

In the embodiment illustrated in FIGS. 1 and 2, a relatively thin flexible sheathing 18B having at least one cut encloses the pencil receiving inlet 17A of the removable lid 11. The flexible sheathing 18B should be made of a material that can be deformed and yet possess sufficient elastic memory to revert to its original shape soon thereafter. Preferably, the sheathing 18B is made from a rubber, flexible plastic or flexible polymer.

FIG. 2 shows the sheathing accommodating the pencil 30 that has partially entered the pencil receiving inlet 17A of the removable lid 11 so that the pencil 30 can come into contact with the cutting blade assembly 20. The sheathing 18B (see FIG. 1) encloses the pencil receiving inlet 17A when the pencil 30 is removed from the pencil sharpener 2, to prevent the back flow of pencil shavings out of the pencil receiving inlet 17A and accidental contact between the cutting blade assembly 20 and the user.

The embodiment shown in FIGS. 1 and 2 is suited for receiving a key chain 22. An extension 16, having a hole 19, extends from the point cutting housing 10 away from the pencil receiving inlet 17. The key chain 22 has an end ring 22A inserted through the hole 19 formed through the extension 16.

Most of the components of present invention are made of plastic to reduce production costs, with the general exception of the key chain 22 and the cutting blade assembly 20 which are preferably made of metal. The cutting blade assembly 20 and the key chain 22 are known to those skilled in the art, and hence variations thereof are hereby incorporated by reference.

It is to be understood that the present invention is not limited to the embodiments described above, but encompasses any and all embodiments within the scope of the following claims.

I claim:

1. A pencil sharpener comprising:

a frame;

at least one point cutting assembly having:

a cutting means; and a pencil receiving inlet adapted to axially position a pencil that is received into the pencil receiving inlet for cutting by said cutting means;

hinge means rotatably attaching said point cutting assembly to said frame, so that when said cutting assembly is retracted into the frame, said pencil receiving inlet and said cutting assembly are covered by said frame, thereby preventing any pencil shavings from flowing back out of the pencil receiving inlet and said cutting assembly, in addition to preventing accidental contact between the user and said cutting means; and locking means for selectively securing and releasing said point cutting assembly to said frame, wherein said locking means include:

a locking structure having a handle portion and a locking nib;

a compression sprint disposed between the handle portion and said locking nib;

said locking structure with said compression spring being disposed in said frame to engage said point cutting assembly and prevent the release of said point cutting structure before the handle portion of said locking structure is engaged to remove the contact between the locking nib of said locking structure and said point cutting assembly, so as to release said point cutting assembly.

2. A pencil sharpener comprising:

a frame having a substantially T-shaped structure, said T-shaped frame is formed by a vertical bar and a horzontal bar;

a pair of point cutting assemblies, each of said cutting assemblies having:

a cutting means; and a pencil receiving inlet adapted to axially position a pencil that is received into the pencil receiving inlet for cutting by said cutting means;

hinge means rotatably attaching said pair of point cutting assemblies to said frame, so that when each of said cutting assemblies is retacted into the frame, said pencil receiving inlet and each of said cutting assemblies are covered by said frame, thereby preventing any pencil shavings from flowing back out of the pencil receiving inlet and each of said cutting assemblies, in addition to preventing accidental contact between the user and said cutting means; and locking means for selectively securing and releasing said point cutting assembly to said frame.

3. The pencil sharpener as recited in claim 2, wherein said hinge means are located at the lower portion of the vertical bar of said T-shaped frame, such that when said point cutting assemblies are unlocked from said frame, said point cutting assemblies swing out laterally from the locked-in positions, exposing the pencil receiving inlets.

4. The pencil sharpener as recited in claim 3, wherein said hinge means further include a pin-in-hole assembly including one pin to hinge both of said pair of point cutting assemblies to said frame.

5. The pencil sharpener as recited in claim 3, wherein said hinge means include:

a spiral spring having end extensions, said extensions contacting both said frame and said point cutting assembly;

said spiral spring twisting and storing spring energy when said point assembly is locked into said frame by said locking means; and said spring untwisting and releasing the stored spring energy when said locking mechanism is released so that said point cutting assembly is readily and rotatably unhinged from said frame.

6. The pencil sharpener as recited in claim 3, wherein said hinge means include two separate pins hinges, one for each of said point cutting assemblies, that attach said point cutting means to said frame.

7. The pencil sharpener as recited in claim 3, further comprising:

a base portion extending from the lower portion of the vertical bar of said T-shaped frame;

said hinge means including a hinge at each of the end sections of the horizontal bar of said T-shaped frame, hinging a pair of said point cutting assemblies such that, when said point cutting assemblies are unlocked from said frame, said point cutting assemblies swing out laterally from the locked-in positions, exposing the pencil receiving inlets, said base portion effectively shielding the pencil receiving inlets of said point cutting assemblies when said locking means engage said point cutting assemblies.

8. The pencil sharpener as recited in claim 3, further comprising a handle portion that extends from one end of the horizontal bar of said T-shaped frame to the other end, forming a substantially semicircular handle structure and defining a cavity above the upper horizontal bar of said T-shaped frame.

9. The pencil sharpener as recited in claim 8, further comprising a key chain having an end ring, said end ring extending around said handle portion and in through said cavity above the horizontal bar of said T-shaped frame to enhance the portability of the pencil sharpener.

10. A pencil sharpener comprising:

a substantially box-shaped frame having an open face wall and lower sidewalls;

a pair of point cutting assemblies which are hinged at the lower sidewalls of said box-shaped frame, each of said cutting assemblies having:

a cutting means; and a pencil receiving inlet adapted to axially position a pencil that is received into the pencil receiving inlet for cutting by said cutting means;

hinge means rotatably attaching said pair of point cutting assemblies to said frame, so that said point cutting assemblies can enter and exit said box-shaped frame via the open face wall of said box-shaped frame, said pencil receiving inlet and each of said cutting assemblies are covered by said frame, thereby preventing any pencil shavings from flowing back out of the pencil receiving inlet and each of said cutting assemblies, in addition to preventing accidental contact between the user and said cutting means; and locking means for selectively securing and releasing said point cutting assembly to said frame.

11. The pencil sharpener as recited in claim 10, further comprising a handle portion that extends from one corner end section of the upper wall of said box-shaped frame to the other end section, forming a substantially semicircular handle structure and defining a cavity above the upper wall of said box-shaped frame.

12. The pencil sharpener as recited in claim 11, further comprising a key chain having an end ring, said end ring extending around said handle portion, and through said cavity above the upper wall of said box shaped frame, to enhance the portability of the pencil sharpener.

* * * * *